US005284516A

United States Patent [19]

Sieberth

[11] Patent Number: 5,284,516

[45] Date of Patent: Feb. 8, 1994

[54] DOCTORING APPARATUS WITH FLEXIBLE BLADE MOUNTING

[75] Inventor: Ralf Sieberth, Appleton, Wis.

[73] Assignee: J. M. Voith GmbH, Heidenheim, Fed. Rep. of Germany

[21] Appl. No.: 926,917

[22] Filed: Aug. 7, 1992

[30] Foreign Application Priority Data

Aug. 7, 1991 [DE] Fed. Rep. of Germany ..... G9109785[U]

[51] Int. Cl.[5] ..... B05C 11/04

[52] U.S. Cl. ..... 118/123; 118/126; 15/256.51

[58] Field of Search ..... 118/100, 123, 122, 126, 118/413, 419; 15/256.5, 256.51

[56] References Cited

U.S. PATENT DOCUMENTS

| | | | |
|---|---|---|---|
| 3,164,492 | 1/1965 | Schmitt et al. | 118/100 |
| 3,190,263 | 6/1965 | Belak | 118/123 |
| 3,260,570 | 7/1966 | Mayhew | 118/123 |
| 3,301,214 | 1/1967 | Coghill | 118/126 |
| 3,356,067 | 12/1967 | Krasnow et al. | 118/123 |
| 3,529,315 | 9/1970 | Dunlap et al. | 118/126 |
| 3,610,203 | 10/1971 | Müller | 118/100 |
| 3,908,590 | 9/1975 | Quint | 118/122 |
| 4,114,228 | 9/1978 | Brown | 118/126 |
| 4,375,202 | 3/1983 | Miller | 118/126 |
| 4,876,982 | 10/1989 | Claassen | 118/413 |

*Primary Examiner*—Karen M. Hastings
*Assistant Examiner*—Steven P. Griffin
*Attorney, Agent, or Firm*—Baker & Daniels

[57] ABSTRACT

A doctoring apparatus includes a doctor blade defining a width and thickness. A support beam supports the doctor blade. A blade mounting includes at least one clamping part for clamping the doctor blade. The clamping part provides flexible mounting of the doctor blade in a transverse direction to the doctor blade and generally rigid mounting of the doctor blade in a direction corresponding to the doctor blade width.

16 Claims, 2 Drawing Sheets

DOCTORING APPARATUS WITH FLEXIBLE BLADE MOUNTING

BACKGROUND OF THE INVENTION

1. Field of the Invention

The present invention relates to a doctoring apparatus, and, more particularly, to a doctoring apparatus having an adjustably mounted doctor blade.

2. Description of the Related Art

Doctoring apparatus for Coating systems for paper or cardboard are known, e.g., from U.S. Pat. No. 3,301,214. Doctor blade adjustment systems, typically in the form of traction-thrust screws, may be used to provide a cross profile adjustment of the applied coating on the paper. With known blade adjustment apparatus, the blade is rigidly clamped in its foot area, and the flexibility occurs in the area where the adjustment device for the local adjustment, or the base load of the blade, is active.

What is needed in the art is a doctor blade adjustment apparatus providing relatively free deformation of the doctor blade in a direction transverse to the doctor blade.

SUMMARY OF THE INVENTION

The present invention provides a doctor blade apparatus providing relatively free deformation of the doctor blade in a direction transverse to the doctor blade.

The doctor blade, particularly the rear region of the blade, is not retained in a rigid mounting. The blade clamping occurs generally in the same region of the clamping parts where the flexibility of the clamping parts is formed.

The invention comprises, in one form thereof, a doctoring apparatus including a doctor blade. The doctor blade defines a length, width and thickness. A support beam supports the doctor blade. A blade mounting includes at least one clamping part for clamping the doctor blade. The clamping part provides flexible mounting of the doctor blade in a transverse direction to the doctor blade and generally rigid mounting of the doctor blade in a direction corresponding to the doctor blade width.

The mounting components of the blade form an integrated unit which is arranged by itself, separately from the actual support beam of the doctoring apparatus.

In certain applications, it may be desirable to use a doctor blade having a thickness which is greater than the thickness of conventional doctor blades, e.g., at least 1 mm. For instance, a thicker blade may allow a larger angle, e.g., at least 45°, between the blade and backing roll. Moreover, a thicker blade allows the blade to be disposed closer to or farther away from an applicator roll, depending on the particular application and the consistency of the coating mixture.

Lastly, successive blades can be positioned on the same support beam. One blade of the successive blades can be a predosing blade with a relatively rigid angular adjustment, or also with a basic adjustment.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
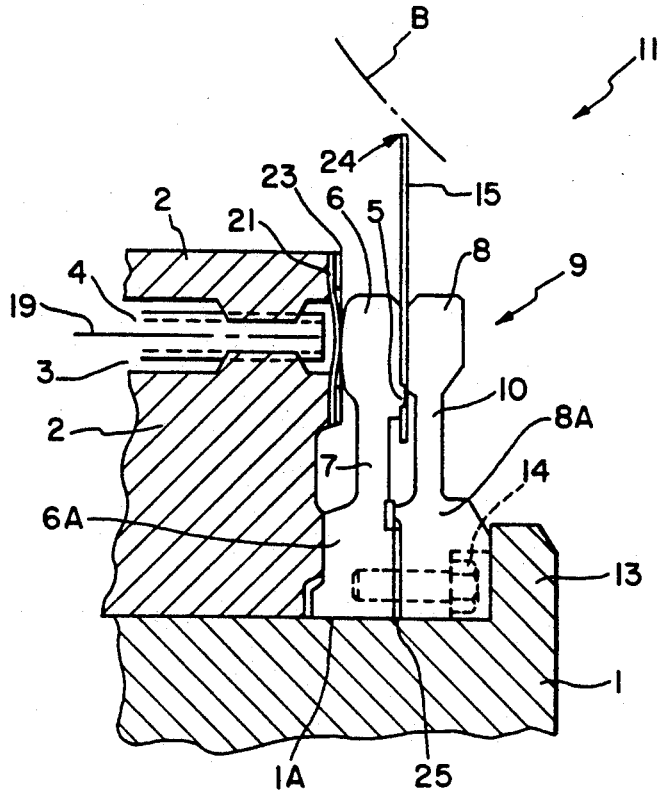
FIG. 1 is a sectional view of one embodiment of the invention.

Corresponding reference characters are used for similar parts, but with one of several prime signs. The exemplifications set out herein illustrate one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a doctor apparatus 11 of the present invention. Doctor apparatus 11 generally includes a support beam 1, doctor blade 15, thrust slat 2 and blade mounting 9.

Support beam 1 defines a support surface 1A for supporting blade mounting 9 and doctor blade 15. A stop 13 is formed in support beam 1. Stop 13, support surface 1A and thrust slat 2 engage and retain blade mounting 9 and doctor blade 15.

Figure 2:
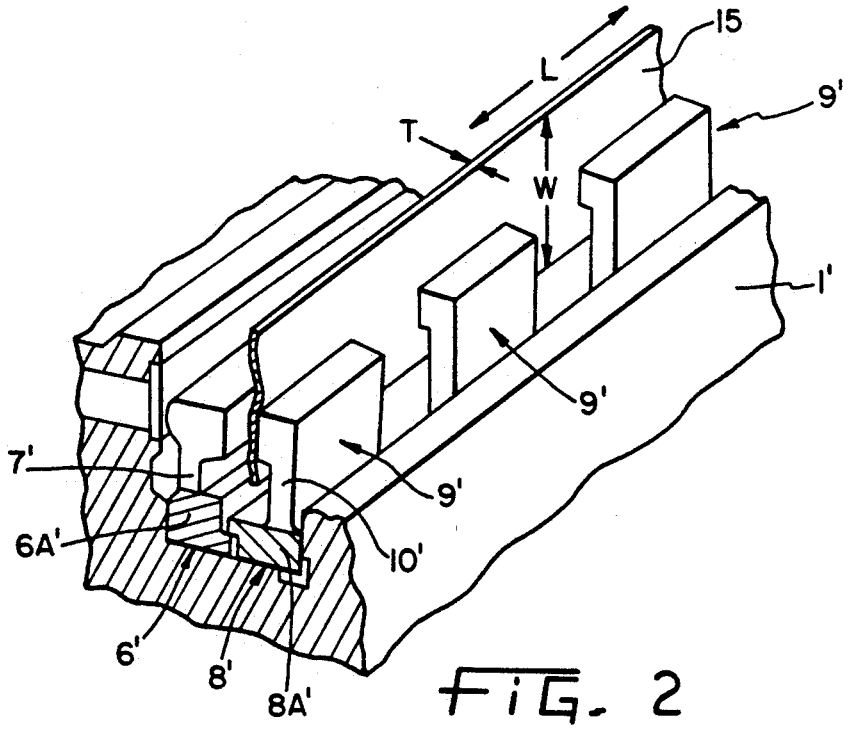
FIG. 2 is a perspective view of an alternative embodiment of the invention.

Doctor blade 15 includes a blade edge 24 for contacting the suspension flow. Referring to FIG. 2, doctor blade 15 has a length L, width W and thickness T. Doctor blade 15 is mounted in blade mounting 9 to define a clamped length.

Blade mounting 9 includes clamping parts 6 and 8. Clamping parts 6 and 8 include relatively flexible sections 7 and 10, respectively, having a cross-sectional thickness (FIG. 1) which is smaller than the remainder of clamping parts 6 and 8. Flexible sections 7 and 10 are formed in clamping parts 6 and 8 in the immediate clamping area of or in the area adjacent to doctor blade 15. Flexible sections 7 and 10 provide flexibility in clamping parts 6 and 8 in a direction transverse to doctor blade 15, and rigidity in clamping parts 6 and 8 in a direction corresponding to width W of doctor blade 15. The distance between flexible sections 7, 7', etc. and 10, 10', etc. and support surface 1A is about the same in each of the embodiments shown in the drawings. Clamping parts 6 and 8 are each formed with a rigid foot area 6A and 8A respectively. Rigid foot areas 6A and 8A may be formed with mating openings (not numbered) adapted to receive screws 14 indicated by broken lines in FIG. 1. Rigid foot areas 6A and 8A may accordingly be interconnected therebetween with screws 14. A shim 25 having a thickness corresponding to the thickness of doctor blade 15, preferably formed from a metal strip, may be provided between and in engagement with rigid foot areas 6A and 8A for adaptation of blade mounting 9 to different doctor blade thicknesses. Blade mounting 9 provides a relatively unimpeded deformation of doctor blade 15, with local load adjustment to and corresponding deform the blade mounting 9 via adjustment screws 4, for adjustment of the cross profile of the suspension flow.

Blade mounting 9 and doctor blade 15 may be formed with mating surfaces for preventing relative movement therebetween. Referring to FIG. 1, a shoulder 5 may be formed on clamping part 6 which mates with a corresponding groove or shoulder formed in or on doctor blade 15, or vice versa. The mating surfaces prevent a positional change of the blade in a direction corresponding to the width of the doctor blade.

Thrust slat 2 is formed with a channel 3 for adjustably carrying adjustment means. In the embodiments shown in the drawings, the adjustment means is a plurality of adjustment screws 4 threadingly engaged with channel 3. Adjustment screws 4 are disposed in thrust slat 2 along the length of doctor blade 15 in one or more channels 3 of thrust slat 2. A center axis 19 of channel 3 is generally disposed at about a right angle to doctor blade 15. Adjustment screws 4 provide local adjustment of doctor blade 15. A protective membrane 21 may be provided for covering channel 3. Protective membrane 21 is preferably a thin strip of metal or plastic. Protective membrane 21 is fastened to thrust slat 2 with a perforated plate 23.

FIG. 2 illustrates an alternative embodiment of the present invention. Clamping parts 6' and 8' form a plurality of individual blade mountings 9' of the doctor blade 15.

In yet another embodiment (not shown), rigid foot areas 6A' and 8A' of clamping parts 6' and 8' (FIG. 2) respectively may be formed as a continuous piece across the entire length of the blade, which corresponds to the length of the backing roll. The upper sections of clamping parts 6' and 8', i.e., the portions of clamping parts 6' and 8' other than the rigid foot areas 6A' and 8A', may be formed with slits for providing local adjustment of doctor blade 15. In such an embodiment, the spaces between clamping parts 6' and 8' illustrated in FIG. 2 would be reduced to only a slit. Such an embodiment would result, so to speak, in a cassette for remote blade installation away from the support beam 1 (FIG. 1) or 1' (FIG. 2).

The ratio of the width of the doctor blade, based on its exposed, unclamped width (i.e., the distance between blade edge 24 and clamping part 9), to the thickness of the doctor blade, may range between 40 and 15. Doctor blades which are considerably thicker than conventional blades may thus be used with the present invention. Use of thicker blades, in turn, allows the angle between the doctor blade and the paper web or backing roll B (FIG. 1) to be larger, e.g., at least 45°.

Figure 3:
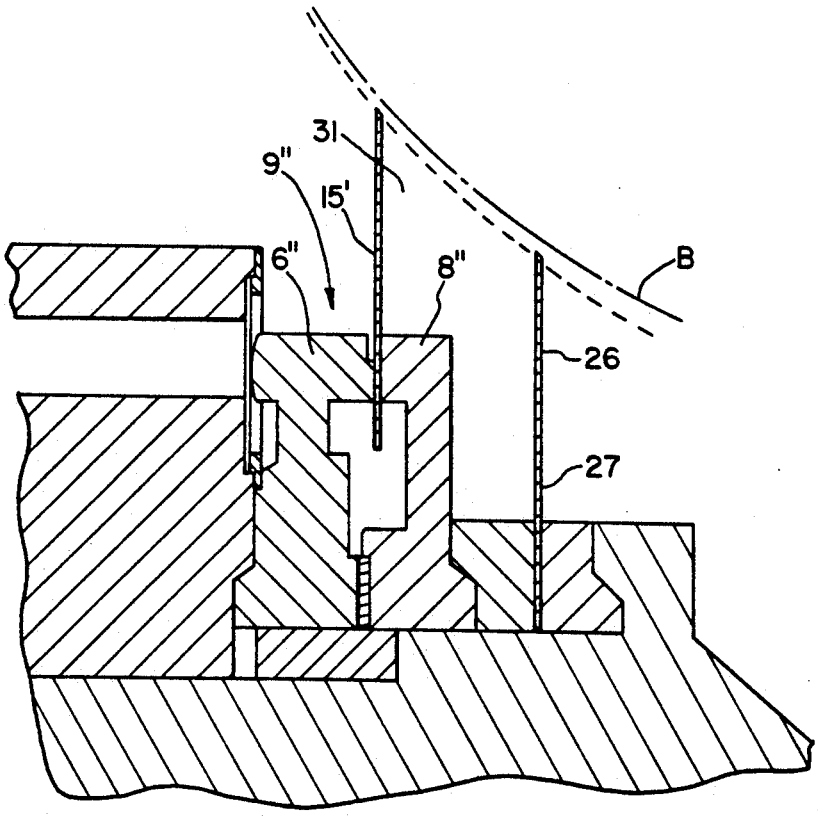
FIG. 3 is a sectional view of an embodiment having two successive doctor blades.

FIG. 3 illustrates another embodiment having two successively disposed doctor blades 15' and 26. Mounting 9'' includes clamping parts 6'' and 8'', similar to clamping parts 6' and 8' described above, for providing flexible mounting of doctor blade 15'. Front blade 26 is relatively rigidly mounted to support beam 1 and functions as a predosing blade. Front blade 26 is disposed ahead of doctor blade 15', i.e., front blade 26 is disposed upstream or ahead of flexibly mounted doctor blade 15' with respect to the direction of rotation of paper web or backing roll B. The two blades 15' and 26 form on the paper web or background B a space 31 from which drains surplus coating mixture removed by the rear blade 15'. One or more drain openings 27 are formed in front blade 26. Drain openings 27 in front blade 26 allow surplus coating mixture to flow therethrough. The embodiment of FIG. 3 may be desirable for predosing and finish dosing where small and slight changes of the blade setting angle are required.

Figure 4:
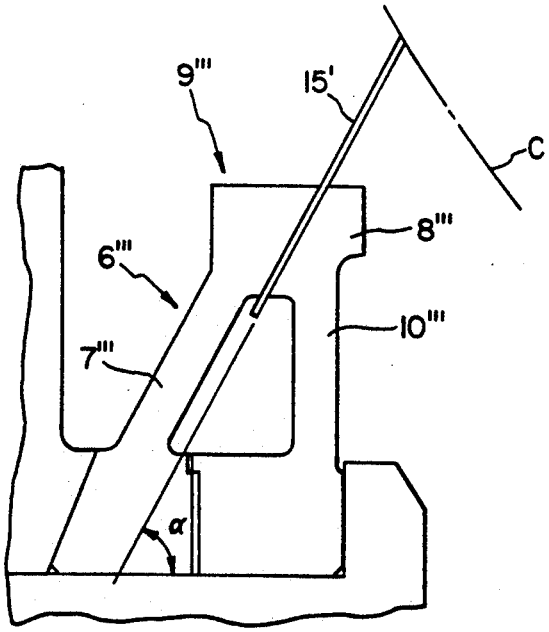
FIG. 4 is a sectional view of another embodiment of the present invention.

FIG. 4 illustrates another embodiment of the present invention. Clamping parts 6''' and 8''' include flexible sections 7''' and 10'''. An angle $\alpha$ is formed between a plane extending through doctor blade 15' (and parallel to the clamping surfaces of the mounting 9''' engaging doctor blade 15') and the support surface 1A of support beam 1. The angle $\alpha$ is preferably less than 90°, e.g., 70°. A blade mounting 9''' as shown in FIG. 4 may simplify the adaptation of the angle formed by the doctor blade with the surface C of the paper web or backing roll to be coated.

In an alternative embodiment (not shown), adjustment wedges may be provided for exact positioning of the doctor blade prior to installation. The adjustment wedges are removed after installation.

In an alternative embodiment (not shown), the adjustment means may be a plurality of piezo translators, bimetallic springs and/or thermal bars for adjustment of the doctor blade to achieve a desired suspension cross profile. If thermal bars are used, they may be heated by heating coils, preferably inductively, dependent upon a control signal representing a desired cross profile of the suspension flow.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A doctoring apparatus, comprising:

a doctor blade, said doctor blade defining a width and thickness;

a support beam, said support beam supporting said doctor blade;

a blade mounting, said blade mounting including two clamping parts for clamping said doctor blade, each said clamping part generally disposed on opposite sides of said doctor blade, each said clamping part, in one of an immediate clamping area of the blade an in an area adjacent to the blade, including a flexible section having a thinned cross sectional thickness transverse to said doctor blade, said flexible section providing flexibility in said clamping parts in a direction transverse to said doctor blade and rigidity in said clamping parts in a direction corresponding to said doctor blade width; and an adjustment means disposed adjacent one of said clamping parts for deforming said blade and said clamping parts.

2. The doctoring apparatus of claim 1, wherein each said clamping part has a rigid foot area, and further comprising a shim, said shim disposed between and in engagement with said rigid foot areas of said two clamping parts, said shim having a thickness corresponding to said doctor blade thickness.

3. The doctoring apparatus of claim 2, further comprising at least one screw, said rigid foot areas formed with mating openings for receiving said screw, said screw fastening said rigid foot areas together.

4. The doctoring apparatus of claim 1, comprising a plurality of said clamping parts independently mounted on said support beam.

5. The doctoring apparatus of claim 1, wherein said clamping parts are mounted independently from said adjustment means.

6. The doctoring apparatus of claim 5, further comprising a thrust slat, said thrust slat having threaded openings for receiving said adjustment means, said adjustment means comprising a screw.

7. The doctoring apparatus of claim 1, wherein said blade mounting and doctor blade define a clamped length, said clamping parts having a length about the same as said clamped length.

8. The doctoring apparatus of claim 1, wherein said support beam defines a support surface, each said flexible section disposed about the same distance from said support surface.

9. The doctoring apparatus of claim 1, wherein said doctor blade has an exposed, unclamped blade width to blade thickness ratio within a range of 40:1 to 15:1.

10. The doctoring apparatus of claim 1, further comprising a rigidly mounted blade secured to said support beam and a rotating backing roll disposed adjacent said doctor blade and said rigidly mounted blade, said rigidly mounted blade disposed ahead of said flexibly mounted doctor blade, relative to a direction of rotation of said backing roll.

11. The doctoring apparatus of claim 10, wherein said rigidly mounted blade includes at least one drain opening for removal of surplus coating mixture.

12. A doctoring apparatus, comprising:

a doctor blade, said doctor blade defining a width and thickness;

a support beam, said support beam supporting said doctor blade;

a blade mounting, said blade mounting including two clamping parts for clamping said doctor blade, each said clamping part generally disposed on opposite sides of said doctor blade, each said clamping part, in one of the immediate clamping area of the blade and in an area adjacent to the blade, including a flexible section having a thinned cross sectional thickness transverse to said doctor blade, said flexible section providing flexibility in said clamping parts in a direction transverse to said doctor blade and rigidity in said clamping parts in a direction corresponding to said doctor blade width, one of said clamping parts including one of a shoulder or groove, and said doctor blade including one of a shoulder or groove for preventing movement of said doctor blade relative to said clamping part, at least one of said clamping parts and said doctor blade including a shoulder.

13. The doctoring apparatus of claim 12, wherein one of said clamping parts has a shoulder and said doctor blade has a groove.

14. The doctoring apparatus of claim 12, wherein one of said clamping parts has a groove and said doctor blade has a shoulder.

15. The doctoring apparatus of claim 12, wherein one of said clamping parts and said doctor blade each include a shoulder.

16. The doctoring apparatus of claim 12, further comprising an adjustment means disposed adjacent one of said clamping parts, said blade and said clamping parts relatively easily deformable by said adjustment means.

* * * * *